US005410815A

United States Patent [19]

Parikh et al.

[11] Patent Number: 5,410,815

[45] Date of Patent: May 2, 1995

[54] AUTOMATIC PLAYER IDENTIFICATION SMALL ARMS LASER ALIGNMENT SYSTEM

[75] Inventors: Himanshu Parikh, San Diego; Fritz W. Healey, Carlsbad, both of Calif.

[73] Assignee: Cubic Defense Systems, Inc., San Diego, Calif.

[21] Appl. No.: 237,717

[22] Filed: Apr. 29, 1994

[51] Int. Cl.[6] ..... F41G 1/54

[52] U.S. Cl. ..... 33/234; 33/275 R; 33/286; 33/DIG. 21; 356/153

[58] Field of Search ..... 33/234, 237, 275 R, 33/286, 533, 645, DIG. 21, 227, 228, 235; 356/138, 153, 140; 42/103, 100

[56] References Cited

U.S. PATENT DOCUMENTS

| | | | |
|---|---|---|---|
| 3,612,949 | 10/1971 | Becraft et al. | 33/286 |
| 4,530,162 | 7/1985 | Forrest et al. | 33/228 |
| 4,712,885 | 12/1987 | Dawson et al. . | |
| 4,899,039 | 2/1990 | Taylor et al. . | |
| 5,001,836 | 3/1991 | Cameron et al. | 33/234 |
| 5,031,349 | 7/1991 | Vogel | 356/153 |
| 5,060,391 | 10/1991 | Cameron et al. | 33/234 |
| 5,222,302 | 6/1993 | DeBatty et al. | 33/234 |

OTHER PUBLICATIONS

Miles Trainer Engineering Report, vol. I, Xerox Electro-Optical Systems, Apr. 22, 1981.

*Primary Examiner*—Christopher W. Fulton

*Attorney, Agent, or Firm*—Baker, Maxham, Jester & Meador

[57] ABSTRACT

A fixture automatically aligns a laser transmitter bolted to a rifle. A case is horizontally oriented and a hinged end cover is swung upwardly to reveal a control unit. The barrel of the rifle is supported on a weapon rest mounted to the base unit and the trigger guard or clip receptacle is mounted in a vise on a sliding rack inside the case. The vise has knobs for adjusting the azimuth and elevation of the weapon, thereby permitting the soldier to aim at a target reticle. An optics unit is mounted on a forward portion of the base unit and includes a lens and a beam splitter which is transparent to infrared light from the laser transmitter but reflective to visible light. The illuminated target reticle is mounted inside the optics unit. The beam splitter is positioned forward of the lens and is angled at forty-five degrees to project the image of the target reticle through the lens at infinity. A position sensor detector receives the laser beam and generates an error signal representative of a displacement between a received location of the laser beam and the image of the target reticle. A circuit causes the alignment head to repetitively trigger the laser in the laser transmitter. Utilizing the error signal, the circuit causes the alignment head to independently rotate wedge prisms in the laser transmitter to steer the laser beam in azimuth and elevation until the laser beam is substantially aligned with a boresight of the weapon.

20 Claims, 5 Drawing Sheets

AUTOMATIC PLAYER IDENTIFICATION SMALL ARMS LASER ALIGNMENT SYSTEM

BACKGROUND OF THE INVENTION

The present invention relates to military training equipment, and more particularly, to a system for automatically aligning a laser transmitter on a rifle for subsequent use by a soldier in war games.

For many years the armed services of the United States have trained soldiers with a multiple integrated laser engagement system (MILES). A laser small arms transmitter (SAT) is affixed to the stock of a rifle such as an M16. Each soldier carries detectors on his helmet and on a body harness adapted to detect a laser "bullet" hit. The soldier pulls the trigger of his or her rifle to fire a blank to simulate the firing of an actual round and an audio sensor triggers the SAT.

It is necessary to align the SAT so that the soldier can accurately hit the target once he or she has it located in the conventional rifle sights. In the past an early version of the SAT was bolted to the rifle stock and the mechanical sights of the weapon were adjusted to align with the laser beam. The disadvantage of this approach is that the mechanical weapon sights must be readjusted in order to use the rifle with live rounds. To overcome this disadvantage the conventional SAT now in use incorporates mechanical linkages for changing the orientation of the laser.

The prior art small arms alignment fixture (SAAF) used by the U.S. Army for alignment of the conventional MILES SAT consists of a complex array of one hundred forty-four detectors which are used in conjunction with thirty-five printed circuit boards to determine where the laser hits with respect to a target reticle. The difficulty in using the prior art SAAF is that the soldier aims his or her weapon at the array which is twenty-five meters away without the use of a stable platform. In many cases, the soldier fires his or her weapon in a manner which results in the aim point not being at the desired location. The fact that the array is located twenty-five meters away from the soldier introduces visibility limitations due to snow, fog, wind and poor lighting conditions at sunrise or dusk. The prior art SAAF calculates the number of error "clicks" in both azimuth and elevation. The number of clicks is then displayed on the prior art SAAF using four sets of electro-mechanical display indicators. The soldier must then turn his conventional SAT's adjustors the corresponding number of clicks in the correct direction. He or she must then aim and fire the weapon again and make additional corresponding adjustments. This iterative process continues until the soldier obtains a zero indication on the prior art SAAF. This is a very time consuming and tedious process due to normal aiming errors incurred each time the soldier has to reacquire the target reticle. It is not uncommon for a soldier to take fifteen minutes to align his or her weapon to the best of his or her ability and still not have it accurately aligned.

Not only is the alignment process utilizing the prior art SAAF time consuming, it is also expensive because a large amount of blank ammunition must be used. The laser of a conventional SAT will not fire without a blank cartridge being ignited or by using a special dry fire trigger cable. The prior art SAAF does not support optical sights, different small arms weapon types, nor night vision devices. Nor does the prior art SAAF accurately verify the laser beam energy and encoding of the received laser beam.

It would therefore be desirable to provide an improved alignment system for a small arms SAT which would eliminate the need to utilize a large target array. Such a system would also preferably automatically adjust the SAT for more rapid and accurate alignment. In addition, preferably such a system would require only a single target sighting and would accommodate different small arms such as automatic weapons, sniper rifles, and so forth. Not only do these small arms have different gun stocks, but in addition, the laser output of their SATs have different powers and codings to enable the manworn portion of a MILES system to discriminate between hits made by different small arms.

SUMMARY OF THE INVENTION

Accordingly, it is the primary object of the present invention to provide an improved small arms alignment system for use in a multiple integrated laser engagement system.

The present invention provides a system for automatic boresight alignment of a laser transmitter mounted to a small arms weapon. The laser transmitter has a laser energizable to emit a laser beam and adjustable to steer the laser beam in azimuth and elevation. The alignment system comprises a base unit having a first optical assembly mounted to the base unit for generating an image of a target reticle visible to a user. A weapon support mounted to the base unit enables the user to adjust an azimuth and an elevation of the weapon to aim the weapon at the image of the target reticle and for holding the weapon in an aimed position. An alignment head is connectable to the laser transmitter for adjusting the transmitter to steer the laser beam in azimuth and elevation. A second optical assembly is mounted to the base unit for receiving the laser beam and for generating an error signal representative of a displacement between a received location of the laser beam and the image of the target reticle. A control circuit is connected to the alignment head and the second optical assembly for energizing the laser and adjusting the laser transmitter utilizing the error signal to steer the laser beam in azimuth and elevation until the laser beam is substantially aligned with a boresight of the weapon.

The preferred embodiment of our invention provides an electro-mechanical fixture that automatically aligns a laser transmitter bolted to the stock of a rifle for subsequent use by a soldier in war games. A rectangular hollow case is horizontally oriented and a hinged end cover is swung upwardly to reveal an LCD display and keypad of a control unit. A sliding rack is extended horizontally from a base unit inside the case. The barrel of the rifle is supported on a weapon rest mounted to the base unit and the trigger guard or clip receptacle is mounted in a vise on the rack. The vise has knobs for adjusting the azimuth and elevation of the weapon, thereby permitting the soldier to aim at an image of a target reticle. An optics unit is mounted on a forward portion of the base unit and includes a lens and a beam splitter which is transparent to infrared light from the laser transmitter but reflective to visible light. The illuminated target reticle is mounted inside the optics unit below the axis of the laser beam. The beam splitter is positioned forward of the lens and is angled at forty-five degrees to project the image of the target reticle through the lens at infinity. A position sensor detector in the optics unit receives the laser beam and generates an error signal representative of a displacement between a received location of the laser beam and the image of the target reticle. A circuit in the control unit is connected to an alignment head which is mechanically coupled with a rear end of the laser transmitter bolted to the rifle. The circuit causes the alignment head to repetitively trigger the laser in the laser transmitter. Utilizing the error signal, the circuit causes the alignment head to independently rotate wedge prisms in the laser transmitter to steer the laser beam in azimuth and elevation until the laser beam is substantially aligned with a boresight of the weapon.

DETAILED DESCRIPTION OF THE PREFERRED EMBODIMENT

Figure 1A:
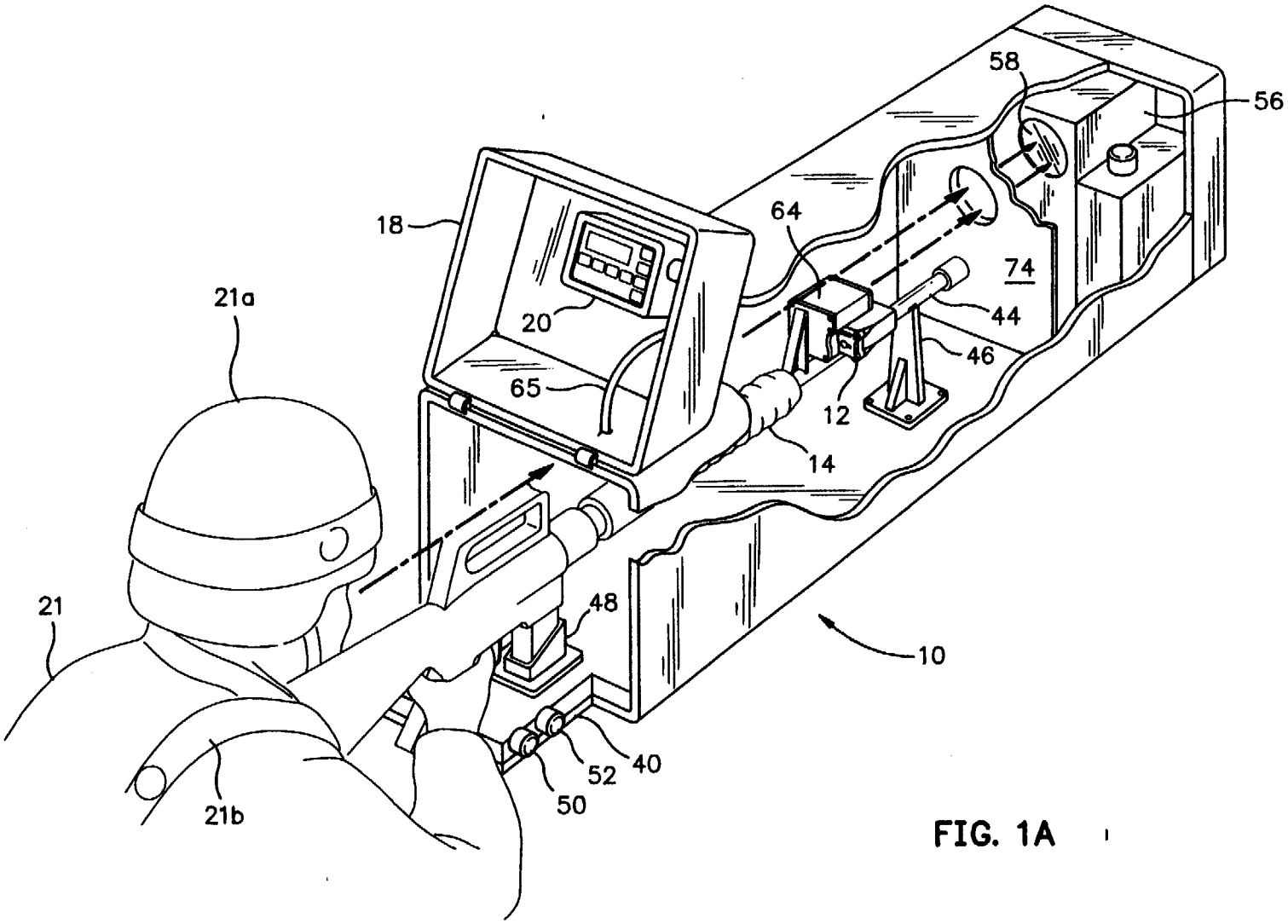
FIG. 1A is a perspective view of a soldier aiming his or her rifle in a preferred embodiment of our automatic player identification small arms laser alignment system.
Figure 1B:
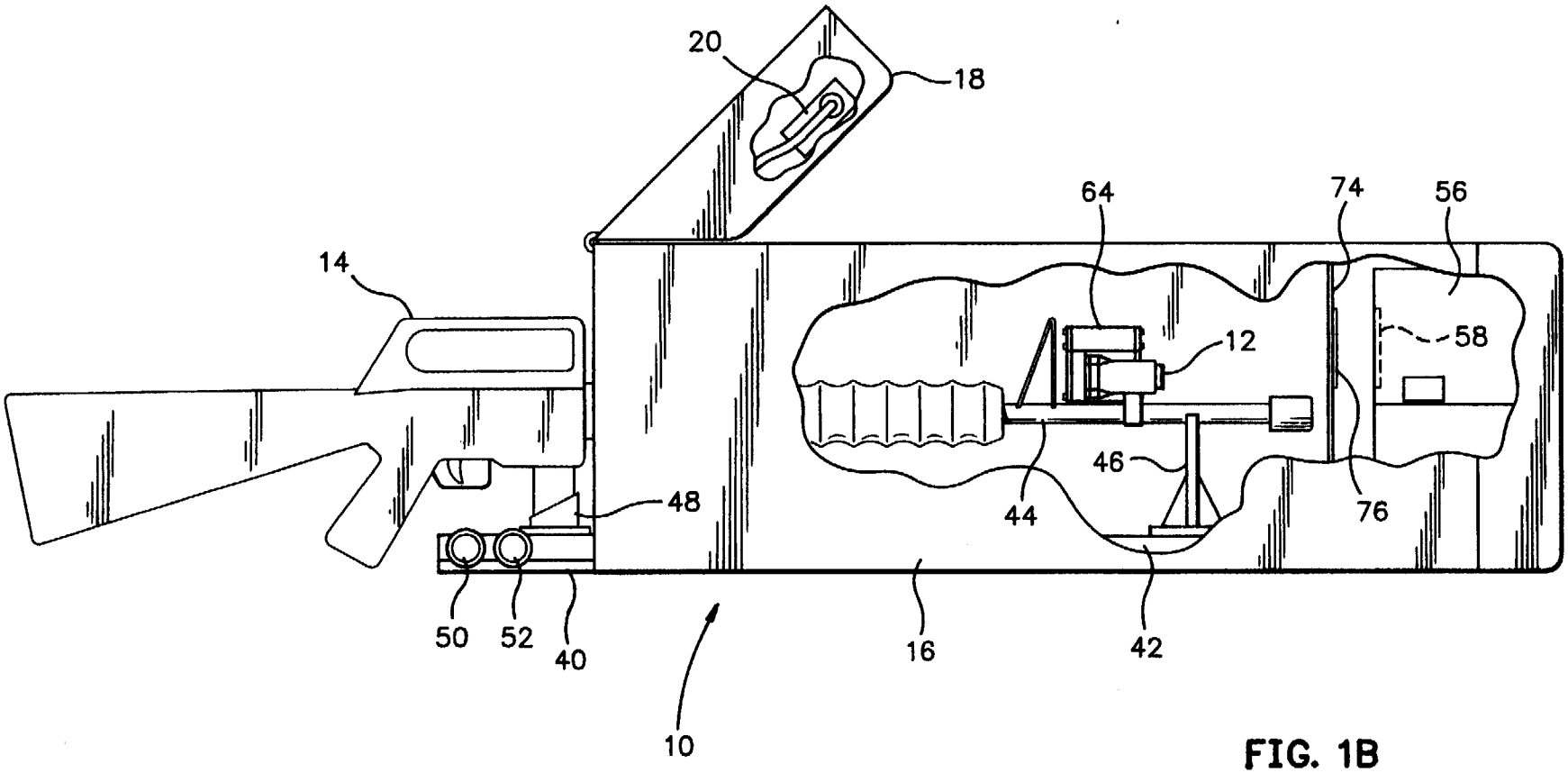
FIG. 1B is a side elevation view of the system of FIG. 1A with portions broken away to reveal further details.
Figure 2:
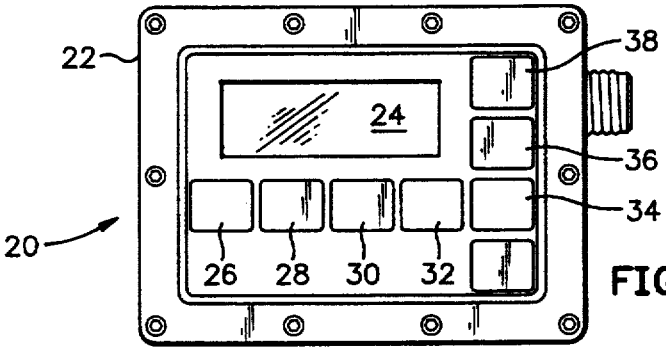
FIG. 2 is an enlarged front elevation view of the display panel and switches of the control unit of the system of FIG. 1A and 1B.

Referring to FIG. 1A and 1B, the preferred embodiment of our invention provides an electro-mechanical system generally designated 10 that automatically aligns a laser transmitter (SAT) 12 bolted to the stock of a small arms weapon 14 such as an M16 rifle for subsequent use by a solder in war games. The system 10 includes a rectangular hollow transit case 16 which is horizontally oriented when in use. A lockable hinged end cover 18 of the case 16 may be swung upwardly to reveal a control unit 20 mounted to the inside thereof. A soldier 21 aims the weapon 14 inside the case 16. The soldier 21 wears a helmet **21*a* and a harness 21*b* equipped with laser detectors which detect laser "bullet" hits in subsequent war games. The control unit includes a box-like housing 22 (FIG. 2) having an LCD display 24. The housing 22 also has a keypad in the form of a membrane switch panel. This switch panel surrounds the display 24 and includes pressure-type switches 26, 28, 30, 32, 34, 36 and 38**.

A retractable sliding rack 40 may be extended horizontally from the rear end of a base unit 42 (FIG. 1B) mounted to the bottom wall of the case 16. A barrel 44 of the rifle 14 is firmly supported on the apex of a rigid triangular weapon rest 46 whose base is securely mounted via bolts to an intermediate portion of the base unit 42. A trigger guard (not visible) of the rifle 14 is mounted in a vise 48 on the rack 40. The vise 48 has knobs 50 and 52 for manually adjusting the azimuth and elevation, respectively, of the barrel 44 of the rile 14. After mounting the rifle 14 on the weapon rest 46 and vise 48, the soldier 21 (FIG. 1A) aims at an image of a target reticle 54 (FIG. 6) projected in the line of sight of the weapon as hereafter described in detail.

A box-shaped optics unit 56 (FIGS. 1A and 1B) is rigidly mounted on the forward portion of the base unit 42 (FIG. 1B). The optics unit 56 includes a convex lens 58 (FIG. 6) and a beam splitter 60. The beam splitter 60 is transparent to infrared light from the laser transmitter (SAT) 12 (FIG. 1) but reflective to visible light. The target reticle 54 (FIG. 6) is mounted inside the optics unit 56 below the axis of the laser beam. The beam splitter 60 is positioned forward of the lens 58 and is angled at forty-five degrees to project the image V of the target reticle through the lens 58 at infinity. A position sensor detector 62 in the optics unit 56 receives the laser beam L2 and generates an error signal representative of a displacement between a received location of the laser beam and the image of the target reticle. The SAT 12 is then adjusted until its laser beam L2 strikes the center of the detector 62.

Figure 3:
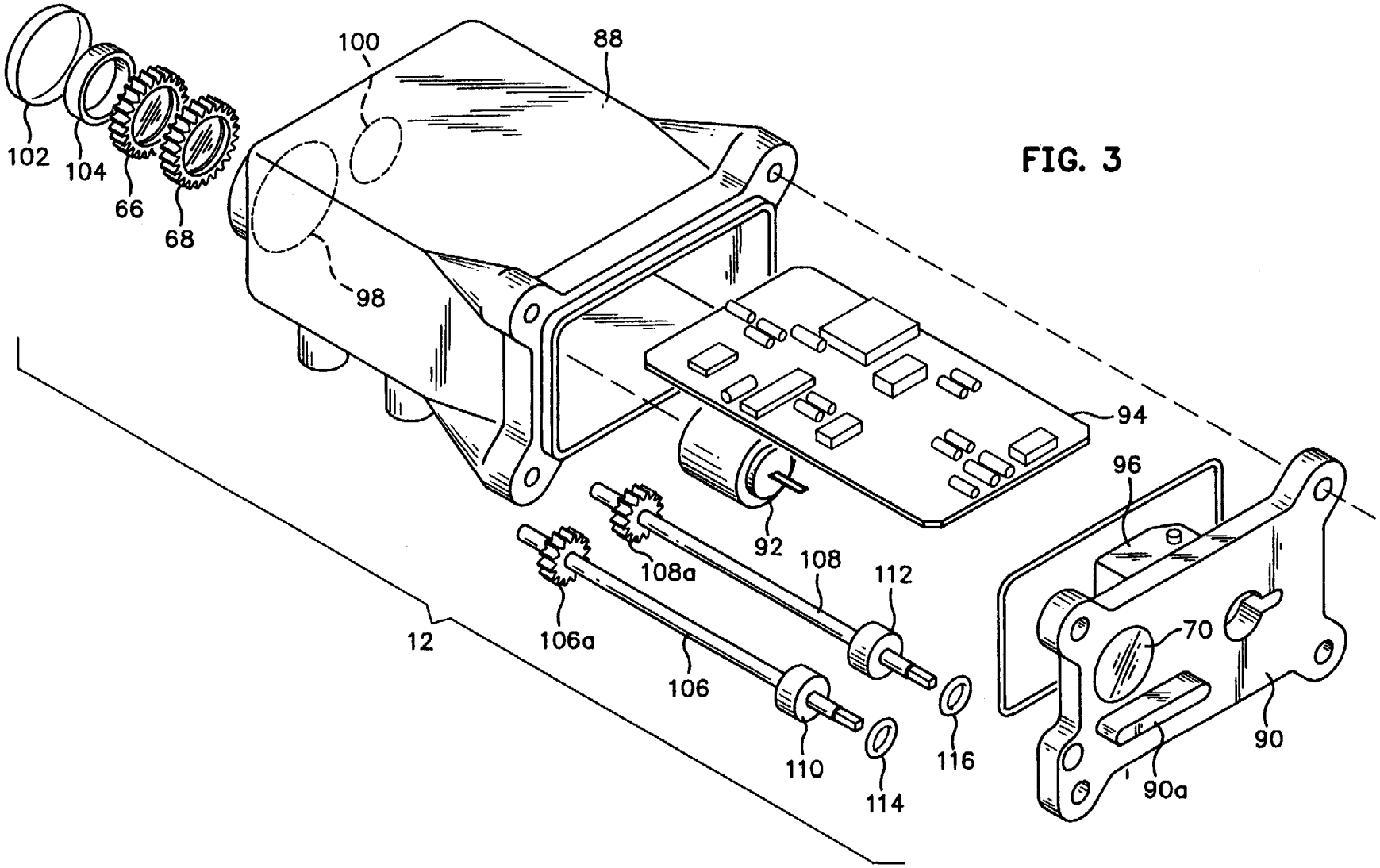
FIG. 3 is an enlarged exploded perspective view of the small arms transmitter (SAT) which is mounted on the rifle shown in FIG. 1A and 1B.

A control circuit inside the control unit 20 (FIG. 1 ) is connected to an alignment head 64 which is mechanically coupled with a rear end of the laser transmitter (SAT) 12 bolted to the rifle 14. The control circuit causes the alignment head 64 to repetitively trigger the laser in the laser transmitter 12. Utilizing the error signal, the control circuit causes the alignment head to independently rotate a pair of wedge prisms 66 and 68 (FIG. 3) in the laser transmitter 12 to steer the laser beam in azimuth and elevation until the laser beam is substantially aligned with a boresight of the barrel 44 of the weapon.

The system 10 may be used for the automatic boresight alignment of all U.S. military specified small arm weapons and machine guns with unlimited adaptability to new weapons. The automatic operation of the system assures rapid (less than one minute), accurate and consistent boresighting of the SAT 12 after a single initial sighting of the weapon 14 by the soldier 21. Use of the sighting vise 48 assures that optical sights and night vision devices on the weapon 14 will not interfere with the boresighting process. The entire system 10 is contained within the rugged transit case 16 which also serves as a sun and foul weather shield. The system 10 does not use blank ammunition during the alignment process and therefore it may be used at any location such as indoors on a table top.

The initial set up of the system 10 involves three simple steps which include installation of a battery into the control unit housing 22 (FIG. 2), activating the BIT switch 30 (FIG. 2) and selecting the weapon type to be aligned by depressing the switch 34. The display 24 will give appropriate text messages and directions to the operator as to how to proceed to the next step. Once the system 10 is ready for alignment the soldier 21 follows the directions on the display 24 to align his or her weapon. The typical sequence is as follows:

a) The soldier attaches the alignment head 64 to the laser transmitter (SAT) 12;

b) The soldier places his or her weapon in the sight vise 48 and front weapon rest 46;

c) The soldier aims his or her weapon at the image of the illuminated target reticle 54 visible in the optics unit using the sighting vise azimuth and elevation adjustment knobs 50 and, 52;

d) The soldier depresses the proceed switch 28 (FIG. 2) and follows the instructions on the display 24. The weapon type is selected by depressing the switch 34 at the appropriate time in response to a query on the display;

e) The soldier backs away and depresses the align switch 26 on the control unit housing 22;

f) The soldier waits for an "ALIGNMENT COMPLETE" message on the display 24 which will occur less than one minute later; and p1 g) The soldier removes the weapon from the system following an alignment completion instruction.

In the event any problems are encountered by the system 10 during the alignment process such as low power, incorrect laser coding or triggering problems, the system will inform the soldier that the weapon's SAT is defective and needs to be replaced.

Figure 7:
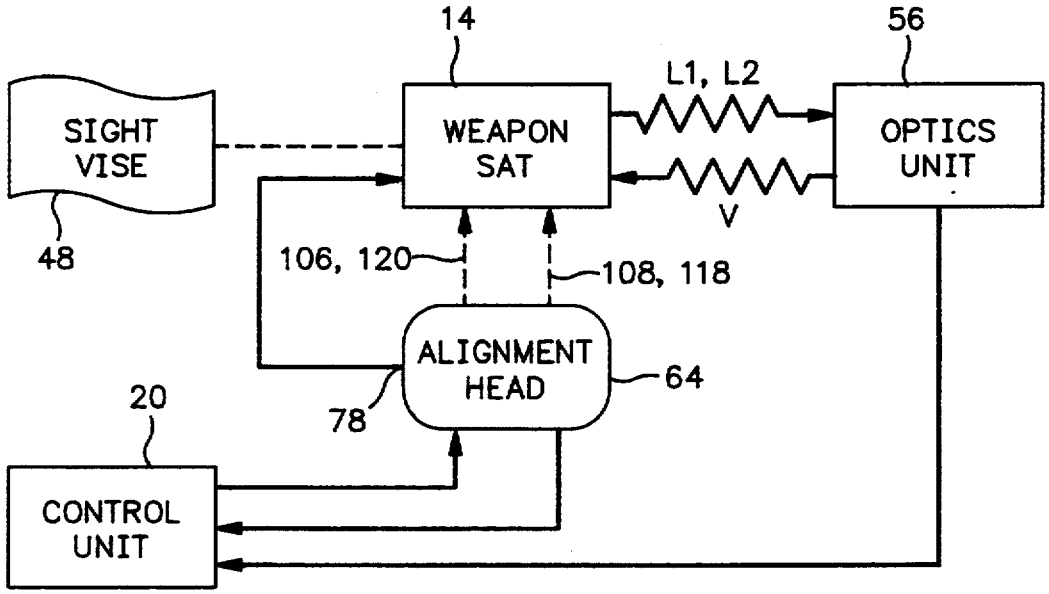
FIG. 7 is an overall block diagram of the system of FIG. 1A and 1B.

The overall operation of the system 10 is illustrated in the block diagram of FIG. 7. The weapon 14 is mounted in the sight vise 48 with the alignment head 64 attached to the SAT 12. The optics unit 56 includes the illuminated target reticle 54 at which the weapon's sights are aimed. When the align switch 26 (FIG. 2) is activated the control unit 20 causes the SAT 12 to be repetitively triggered while monitoring the SAT's fire LED 70 (FIG. 3) indicator for proper operation. The optics unit 20 senses the location of the laser and sends that data to the control unit 20 which in turn determines the amount of correction needed. The control unit 20 in turn causes the alignment head 64 to make the necessary adjustments to the SAT 12. The process continues in real time until the SAT 12 is precisely aligned. The control unit 20, in conjunction with the optics unit 56, also checks for laser power levels, laser codes and that the SAT'S alignment optics are performing as desired. The five major sub-assemblies of the system 10 are discussed in further detail hereafter.

Figure 6:
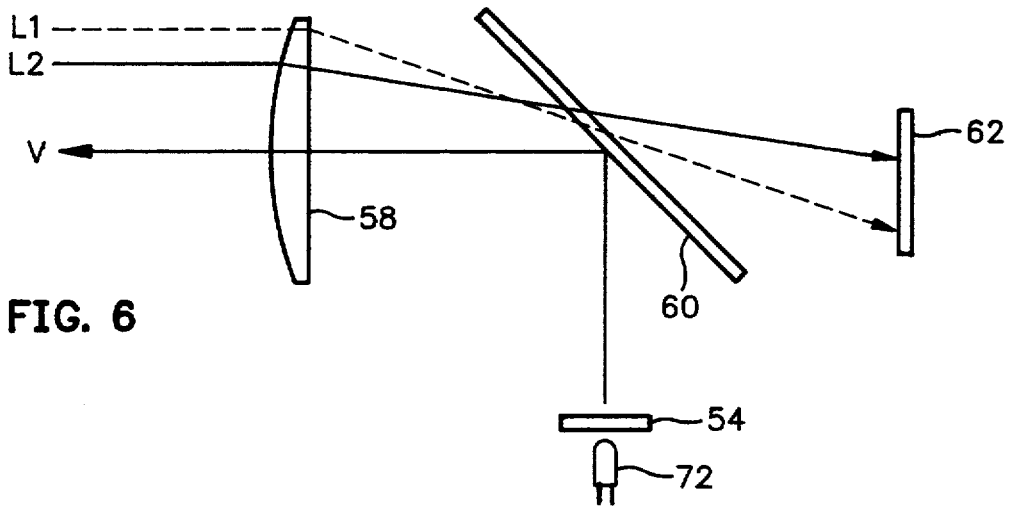
FIG. 6 is a diagrammatic illustration of the lens, beam splitter, target reticle and position sensor detector of the optics unit of the system of FIG. 1A and 1B.

The optics unit 56 (FIGS. 1B) is the assembly which projects the illuminated target reticle 54 to the soldier 21 during boresighting and senses the location of the weapon's laser beam with respect to the reticle. The illuminated reticle 54 assists the soldier 21 in boresighting during reduced lighting conditions such as dusk or dawn. FIG. 6 illustrates the operation of the principal components of the optics unit 56. The single large convex lens 58 serves the function of collimating and focusing the laser beam to a spot at the longitudinal position sensor detector 62 which is located at the focal point of the lens 58. When the angle of incidence to the lens 58 of the laser beam is not perpendicular (mis-aligned) the position of the spot on the detector 62 is offset. The detector 62 passively quantifies the amount of offset and sends the error to the control unit 20. The detector is preferably a solid state device such as a quad-detector or it may be a linear detector with an analog output. Within the path of the laser beam is the beam splitter 60 which is reflective to visible light while allowing the infrared light from the laser to pass through the same. The beam splitter 60 is supported at a forty-five degree angle to project an image of the target reticle 54 through the same lens as the incoming laser. The sighting target reticle 54 is illuminated by a visible light source such as an LED 72 and is positioned such that the projected image is on the same optical axis as the zero point of the position sensor detector 62. No field adjustments of the optics unit 56 are required and the system 10 need not contain any electronics other than the detector 62 and the LED light source 72 for illuminating the target reticle 54.

An L-shaped protective barrier 74 (FIG. 1) is rigidly secured via bolts to the base unit 42 between the tip of the barrel 44 of the weapon and the optics unit 56. It prevents the soldier from inadvertently striking the lens 58 of the optical unit with the barrel 44 when mounting the rifle 14 on the weapon rest 46 and vise 48. The barrier has a hole therethrough covered by a metal screen 76 for allowing the laser beam, which may be eight millimeters wide to pass through the same to the optics unit 56. Glass or some other solid transparent covering for the hole may not be desirable because it could become dirty, attenuate the laser beam, or deflect the laser beam and thereby introduce inaccuracies.

Figure 5A:
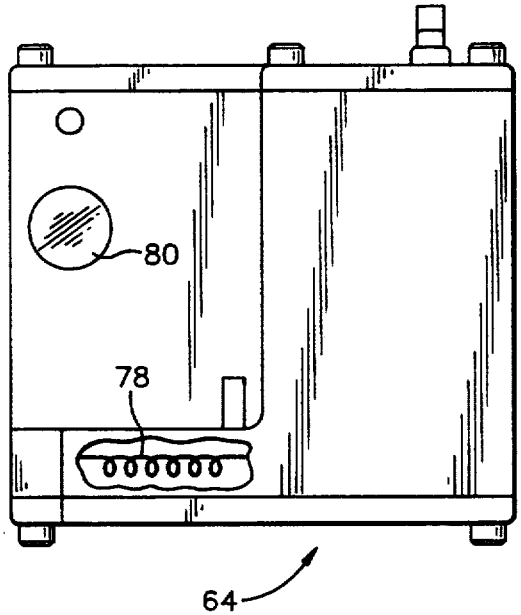
FIG. 5A and 5B are side and from elevation views of the alignment head of the system of FIGS. 1A and 1B.
Figure 5B:
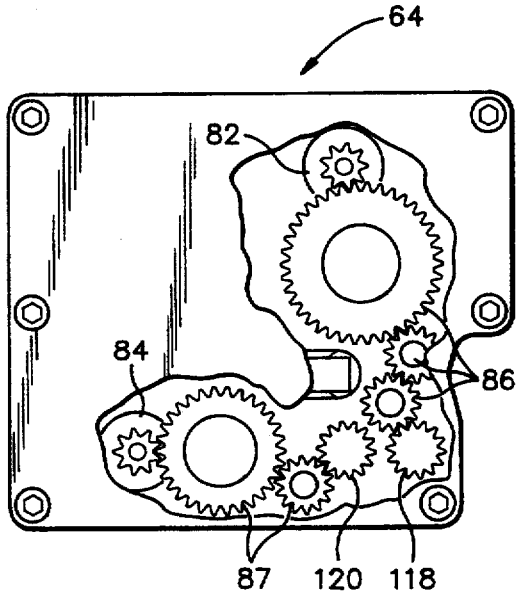

The alignment head 64 (FIGS. 5A and 5B) is an electromechanical device which is attached to the SAT 12 via a cable 65 (FIG. 1A) and automatically adjusts the SAT's laser position as directed by the control unit 20. The alignment head 64 contains an inductive coil 78 (FIG. 5A) which is used to trigger the SAT's laser and if requested via switch 30 (FIG. 2) transfers a testing player identification (PID) to the SAT. The head 64 also has a detector 80 which monitors the SAT's fire LED 70 to determine its operational status. Two miniature reduction geared motors 82 and 84 (FIG. 5B) and an associated offset gear trains 86 and 87 within the alignment head 64 are used to rotate non-slip couplings (not visible) on a pair of geared shafts 118 and 120. The couplings fit over the ends of the SAT's adjustment shafts 106 and 108. The alignment head motors 82 and 84 are driven and controlled by the control unit 20 during the boresighting process while the optics unit 56 senses the SAT's laser and provides real time feedback to the control unit 20.

The laser transmitter (SAT) 12 (FIG. 3) includes a housing assembly 88 with a removable cover assembly 90 which forms a rear end thereof. A laser diode assembly 92 is mounted within the housing assembly 88 and is energized by a power circuit on a controller board 94 also mounted within the housing assembly 88. The power circuit is actuated to energize the laser diode assembly 92 by an inductive switch 96 mounted to the inside of the rear cover assembly 90. The inductive switch is actuated by energization of the induction coil 78 (FIG. 5A) which overlaps the top on the housing assembly 88 (FIG. 3) in alignment with the inductive switch 96.

The forward end of the SAT housing assembly 88 (FIG. 3) is formed with holes 98 and 100. An audio or optical sensor for detecting the firing of a blank cartridge is located in the hole 100 and connected to the circuit on the controller board 94. A transparent window 102 for permitting passage of the beam from the laser diode assembly 92 is mounted in the other window 98. An optical sleeve 104 is positioned behind the window 102. The optical wedges 66 and 68 are rotably supported behind the window 102 for independent rotation via drive shafts 106 and 108, respectively. The forward ends of these shafts have gears **106*a* and 108*a* for engaging toothed peripheral portions of the optical wedges 66 and 68, respectively. The drive shafts 106 and 108 are journaled in bearings such as 110 and 112. The rear ends of the drive shafts 106 and 108 extend through holes (not visible) in the rear cover assembly 90 which are sealed by O-rings 114 and 116. These shaft ends are protected by a rigid flange 90a that extends perpendicularly from the rear cover assembly 90. When the alignment head 64 (FIGS. 5A and 5B) is coupled to the rear cover assembly 90 of the laser transmitter (SAT) 12, the non-slip couplings (not visible) on the geared shafts 118 and 120 (FIG. 5B) of the alignment head 64 connect with the ends of the shafts 106 and 108 to provide driving connections to the motors 82 mid 84**.

Figure 4:
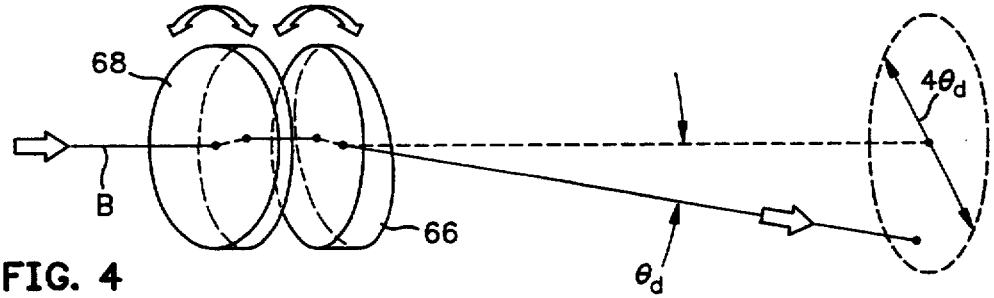
FIG. 4 is a diagrammatic illustration of laser beam-steering using optical wedges.

FIG. 4 illustrates diagrammatically the steering of the laser beam B by independent rotation of the optical wedges 66 and 68 via motors 82 and 84 of the alignment head 64. Optical wedges may be used as beamsteering elements in optical systems. The minimum deviation or deflection experienced by a ray or beam in passing through a thin wedge of apex angle $\theta_w$ is approximately given by $\theta_d=(n-1)\ \theta_{w9}$ where n is the reflective index. The "power" ($\Delta$) of a prism is measured in prism diopters, a prism diopter being defined as a deflection of 1 cm at a distance of one meter from the prism. Thus $\Delta=100\ \tan(\theta_d)$. By combining two wedges of equal power (equal deviation) in near contact, and independently rotating them about an axis roughly parallel to the normals of their adjacent faces, a laser beam B passing through the combination can be steered in any direction, within a narrow cone, about the path of the undeviated beam. The angulular radius of this cone is approximately $\theta_d$. Apex angle is controlled to within very tight tolerances in the manufacturing process of the wedges. As a result of the melt-to-melt index tolerance, deviation angles (functions of wave-length) are nominally specified.

The deviation angles are specified with the assumption that the input beam is normal to the perpendicular face. At other input angles the deviation will, of course, be different. To determine the deviation angle for the same input direction but other wavelengths, the equation is: $\theta_d=\arcsin(n \sin \theta_w)-\theta_{w'}$ where $\theta_d$ is the deviation angle, $\theta_w$ is the wedge angle and $\theta_{w'}$ the normal index at the appropriate wavelength. Optical wedges are available in various materials, such as synthetic fused silica, and in different shapes and sizes.

The control unit 20 (FIG. 1A) provides the user-friendly LCD display 24 (FIG. 2) and controls which continuously inform the user of his weapon status while progressively instructing him throughout the alignment process. The control unit 20 is mounted inside the transit case cover 18. The LCD display 24 can be easily read when the cover 18 is in raised open position. As described above the control unit 20 provides all controls and monitors all activities of the optics and alignment head units 56 and 64. The front membrane switch panel with its integral 4×20 LCD display 24 provides the user interface. The switch functions are described as follows:

a) ALIGN (26)—This switch is activated by the soldier after he or she has aimed the weapon's sights at the optics units target reticle.

b) PROCEED (28)—This switch is activated any time the soldier desires to move to the next alignment step or to acknowledge a displayed message.

c) BIT (30)—This switch is activated during initial setup of the system to verify its ready status.

d) PID LEARN (32)—This switch is used to transfer the system's test PID to the SAT 12 in order to verify that the transfer function operators. Use of this switch is optional and is only used if there is some question as to the SAT of the cradled weapon being able to accept other PIDs.

e) WEAPON SELECT (34)—This switch is used in conjunction with the two arrow switches 36 and 38 to select the type of weapon to be aligned (M16A2, M2, M240 etc.). This selection determines which power levels and codes are to be verified by the system.

f) ARROWS (36 and 38)—These switches are used to select the different weapon types.

The sighting vise 48 (FIG. 1B) is a stable mechanism used to hold and aim the weapon 14 under alignment. It allows the soldier to boresight using any aiming bias introduced by his method of aiming and eliminates any weapon wandering away from the aim point. The vise 48 is attached to the sliding rack 40 which retracts into the transit case base unit 42 to accommodate the different lengths of weapons. The sight vise 48 has both elevation and azimuth adjustment knobs 50 and 52 allowing the soldier to accurately aim his weapon's sights at the image of the target reticle 54. The front portion of the weapon barrel 44 rests on the weapon rest 46 located within the transit case 16 on the transit case base unit 42.

The major components of the system 10 are integral to the transit case 16 which provides a secure and rugged environment during transport and operation. The case 16 also provides a sun and foul weather shield to allow the alignment process to be accomplished in any expected environment. The base unit 42 is mounted on the bottom wall of the case. The optics unit 56, weapon rest 46 and sliding sight vise rack 40 are attached to the base unit. The battery (not visible) for powering the system is housed inside the base unit 42. The control unit 20 is attached to the inside of the front cover 18A.

Figure 8:
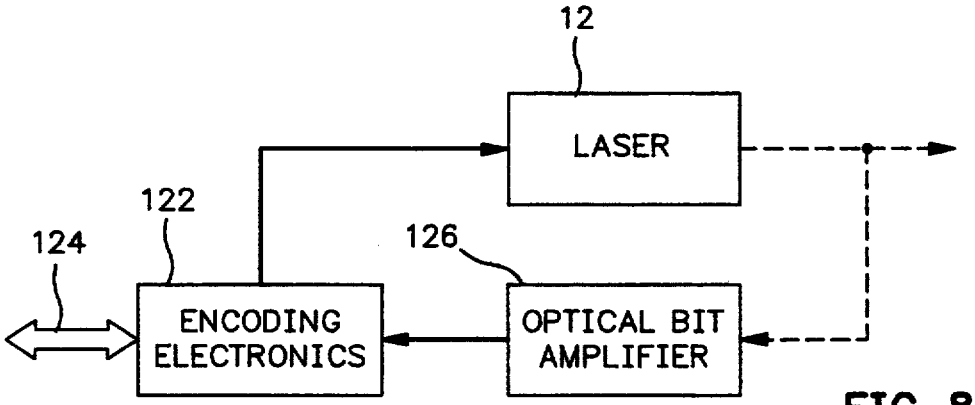
FIG. 8 is a block diagram of the optical output power and code accuracy verification circuit of the control unit of the system of FIG. 1A and 1B.

FIG. 8 is a block diagram of the optical output power and code accuracy verification circuit of the control unit 20. An encoding circuit 122 is connected via a serial data bus 124 to a microcomputer (not illustrated). An optical bit amplifier 126 in the path of the laser beam outputs signals to the encoding electronics.

While we have described a preferred embodiment of our automatic player identification small arms laser alignment system, it will be apparent to those skilled in the art that our invention can be modified in both arrangement and detail. Therefore, the protection afforded our invention should only be limited in accordance with the following claims.

We claim:

1. A system for automatic boresight alignment of a laser transmitter mounted to a small arms weapon, the laser transmitter having a laser energizable to emit a laser beam and being adjustable to steer the laser beam in azimuth and elevation, the system comprising:

a base unit;

first optical means mounted to the base unit for generating an image of a target reticle visible to a user;

means mounted to the base unit for supporting the weapon and enabling the user to adjust an azimuth and an elevation of the weapon to aim the weapon at the image of the target reticle and for holding the weapon in an aimed position;

alignment head means connectable to the laser transmitter for adjusting the transmitter to steer the laser beam in azimuth and elevation;

second optical means mounted to the base unit for receiving the laser beam and for generating an error signal representative of a displacement between a received location of the laser beam and the image of the target reticle; and control circuit means connected to the alignment head means and the second optical means for energizing the laser and adjusting the laser transmitter utilizing the error signal to steer the laser beam in azimuth and elevation until the laser beam is substantially aligned with a boresight of the weapon.

2. A system for automatic boresight alignment of a laser transmitter mounted to a small arms weapon according to claim 1 and further comprising a case for enclosing the base unit, the first and second optical means, the weapon supporting means and the control circuit means.

3. A system for automatic boresight alignment of a laser transmitter mounted to a small arms weapon according to claim 2 wherein the case has a hinged cover which is openable to a raised position and the control circuit means is mounted on an inside of the cover for viewing by the user when the cover is in its raised position.

4. A system for automatic boresight alignment of a laser transmitter mounted to a small arms weapon according to claim 1 wherein the weapon supporting means includes a rest mounted to the base unit for engaging and supporting a barrel of the weapon.

5. A system for automatic boresight alignment of a laser transmitter mounted to a small arms weapon according to claim 1 wherein the weapon supporting means includes a vise having azimuth and elevation adjustment knobs.

6. A system for automatic boresight alignment of a laser transmitter mounted to a small arms weapon according to claim 1 wherein the weapon supporting means includes a rack slidably mounted to the base unit.

7. A system for automatic boresight alignment of a laser transmitter mounted to a small arms weapon to claim 6 wherein the weapon supporting means further includes a vise mounted to the rack and including azimuth and elevation adjustment knobs.

8. A system for automatic boresight alignment of a laser transmitter mounted to a small arms weapon according to claim 1 wherein the first optical means includes a target reticle, means for illuminating the target reticle with visible light, and means for projecting an image of the target reticle in front of an end of a barrel of the weapon and in a predetermined alignment with the second optical means.

9. A system for automatic boresight alignment of a laser transmitter mounted to a small arms weapon according to claim 1 wherein the second optical means includes a position sensor detector for generating the error signal and a lens for focusing the laser beam to a spot at a longitudinal position of the position sensor detector.

10. A system for automatic boresight alignment of a laser transmitter mounted to a small arms weapon according to claim 1 wherein the first optical means includes a target reticle and means for illuminating the target reticle with visible light, and the second optical means includes a position sensor detector for generating the error signal, and the first and second optical means share a lens and a beam splitter positioned between an end of a barrel of the weapon and the position sensor detector, the lens being shaped and positioned to focus the laser beam into a spot at a longitudinal position of the position sensor detector, the beam splitter being reflective to visible light and transparent to the laser beam and positioned at an angle relative to an axis of the laser beam for projecting the image of the illuminated target reticle in front of the end of the barrel in alignment with the position sensor detector.

11. A system for automatic boresight alignment of a laser transmitter mounted to a small arms weapon, the laser transmitter having a laser energizable by actuation of a trigger sensor to emit a laser beam which is independently steerable in azimuth and elevation by separate actuation of corresponding azimuth and elevation adjustors on the transmitter, the system comprising:

an elongate horizontal base unit;

first optical means mounted to a forward portion of the base unit for generating an image of a target reticle visible to a user;

means mounted to the base unit for horizontally supporting the weapon and enabling the user to manually adjust an azimuth and an elevation of the weapon to aim the weapon at the image of the target reticle and for holding the weapon in an aimed position;

alignment head means releasably connectable to the laser transmitter for actuating the trigger sensor of the laser transmitter and for separately actuating the azimuth and elevation adjustors of the laser transmitter;

second optical means mounted to the forward portion base unit for receiving the laser beam and for generating an error signal representative of a displacement between a received location of the laser beam and the target reticle; and control circuit means connected to the alignment head means and the second optical means for repetitively actuating the trigger sensor and for actuating the azimuth and elevation adjustors of the laser transmitter utilizing the error signal until the laser beam is substantially aligned with a boresight of the weapon.

12. A system for automatic boresight alignment of a laser transmitter mounted to a small arms weapon according to claim 11 and further comprising a case for enclosing the base unit, the first and second optical means, the weapon supporting means and the control circuit means, the case having a hinged cover which is openable to a raised position and the control circuit means being mounted on an inside of the cover for viewing by the user when the cover is in its raised position.

13. A system for automatic boresight alignment of a laser transmitter mounted to a small arms weapon according to claim 12 wherein the weapon supporting means includes a rest mounted to the base unit for engaging and supporting a barrel of the weapon, a rack slidably mounted to the base unit and a vise mounted to the rack and having azimuth and elevation adjustment knobs.

14. A system for automatic boresight alignment of a laser transmitter mounted to a small arms weapon according to claim 11 wherein the first optical means includes a target reticle, means for illuminating the target reticle with visible light, and means for projecting an image of the target reticle in front of an end of a barrel of the weapon and in a predetermined alignment with the second optical means.

15. A system for automatic boresight alignment of a laser transmitter mounted to a small arms weapon according to claim 11 wherein the second optical means includes a position sensor detector for generating the error signal and a lens for focusing the laser beam to a spot at a longitudinal position of the position sensor detector.

16. A system for automatic boresight alignment of a laser transmitter mounted to a small arms weapon according to claim 11 wherein the first optical means includes a target reticle and means for illuminating the target reticle with visible light, and the second optical means includes a position sensor detector for generating the error signal, and the first and second optical means share a lens and a beam splitter positioned between an end of a barrel of the weapon and the position sensor detector, the lens being shaped and positioned to focus the laser beam into a spot at a longitudinal position of the position sensor detector, the beam splitter being reflective to visible light and transparent to the laser beam and positioned at an angle relative to an axis of the laser beam for projecting the image of the illuminated target reticle in front of the end of the barrel in alignment with the position sensor detector.

17. A system for automatic boresight alignment of a laser transmitter mounted to a small arms weapon according to claim 11 wherein the alignment head means includes first and second motor drive means for engaging and rotating a pair of optical wedges in the laser transmitter.

18. A system for automatic boresight alignment of a laser transmitter mounted to a small arms weapon according to claim 11 wherein the alignment head means includes a fire detector for detecting the illumination of a firing indicator on the laser transmitter.

19. A system for automatic boresight alignment of a laser transmitter mounted to a small arms weapon according to claim 11 wherein the control circuit means includes a display and a plurality of manually actuable switches for providing an interface to the user.

20. A system for automatic boresight alignment of a laser transmitter mounted to a small arms weapon, the laser transmitter having a laser energizable by actuation of a trigger sensor to emit a laser beam which is independently steerable in azimuth and elevation by separate actuation of corresponding azimuth and elevation adjustors on the transmitter, the system comprising:

an elongate horizontal base unit;

first optical means mounted to a forward portion of the base unit for generating an image of a target reticle visible to a user, including a target reticle and means for illuminating the target reticle with visible light;

means mounted to the base unit for horizontally supporting the weapon and enabling the user to manually adjust an azimuth and an elevation of the weapon to aim the weapon at an image of the target reticle and for holding the weapon in an aimed position, the weapon supporting means including a rest mounted to the base unit for engaging and supporting a barrel of the weapon, a rack slidably mounted to the base unit and a vise mounted to the rack and having azimuth and elevation adjustment knobs;

alignment head means releasably connectable to the laser transmitter for actuating the trigger sensor of the laser transmitter and for separately actuating the azimuth and elevation adjustors of the laser transmitter, the alignment head means including first and second motor drive means for engaging and rotating a pair of optical wedges in the laser transmitter and a fire detector for detecting the illumination of a firing indicator on the laser transmitter;

second optical means mounted to the forward portion base unit for receiving the laser beam and for generating an error signal representative of a displacement between a received location of the laser beam and the target reticle, including a position sensor detector for generating the error signal;

the first and second optical means sharing a lens and a beam splitter positioned between an end of the barrel and the position sensor detector, the lens being shaped and positioned to focus the laser beam into a spot at a longitudinal position of the position sensor detector, the beam splitter being reflective to visible light and transparent to the laser beam and positioned at an angle relative to an axis of the laser beam for projecting the image of the illuminated target reticle in front of the end of the barrel in alignment with the position sensor detector;

control circuit means connected to the alignment head means and the second optical means for repetitively actuating the trigger sensor and for actuating the azimuth and elevation adjustors of the laser transmitter utilizing the error signal until the laser beam is substantially aligned with a boresight of the weapon, the control circuit means including a display and a plurality of manually actuable switches for providing an interface to the user; and a case for enclosing the base unit, the first and second optical means, the weapon supporting means and the control circuit means, the case having a hinged cover which is openable to a raised position to permit sliding extension of the rack and mounting of the weapon on the supporting means, and the control circuit means being mounted on an inside of the cover for viewing by the user when the cover is in its raised position.

* * * * *